US006405813B1

(12) United States Patent
Kleine et al.

(10) Patent No.: US 6,405,813 B1
(45) Date of Patent: Jun. 18, 2002

(54) ROCK DRILL FOR DRILLING BORES IN REINFORCED CONCRETE

(75) Inventors: Werner Kleine, Achim; Hans-Werner Bongers-Ambrosius, Munich, both of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/658,900

(22) Filed: Sep. 11, 2000

(30) Foreign Application Priority Data

Sep. 9, 1999 (DE) ..... 199 42 986

(51) Int. Cl.[7] ..... E21B 10/46

(52) U.S. Cl. ..... 175/420.1; 175/394; 175/415; 175/426; 175/427

(58) Field of Search ..... 175/420.1, 427, 175/426, 415, 414, 394

(56) References Cited

U.S. PATENT DOCUMENTS

| | | | | |
|---|---|---|---|---|
| 2,040,074 A | | 5/1936 | Brenholm | |
| 3,089,552 A | * | 5/1963 | Black et al. | 175/400 |
| 4,903,787 A | * | 2/1990 | Moser et al. | 175/415 |
| 4,951,761 A | * | 8/1990 | Peetz et al. | 175/398 |
| 5,265,688 A | * | 11/1993 | Rumpp et al. | 175/394 |
| 5,779,403 A | * | 7/1998 | Kleine et al. | 408/230 |
| 5,836,410 A | * | 11/1998 | Kleine | 175/415 |
| 6,032,749 A | * | 2/2000 | Bongers-Ambrosius et al. | 175/394 |
| 6,032,750 A | * | 3/2000 | Kersten et al. | 175/398 |
| 6,089,337 A | * | 7/2000 | Kleine et al. | 175/394 |
| 6,116,361 A | * | 9/2000 | Kleine et al. | 175/415 |
| 6,283,232 B1 | * | 9/2001 | Batliner et al. | 175/415 |

FOREIGN PATENT DOCUMENTS

| | | |
|---|---|---|
| DE | 9537900 | 4/1997 |
| DE | 9722518 | 12/1998 |
| EP | 0351493 | 8/1993 |
| EP | 0563561 | 10/1993 |
| EP | 0778391 | 6/1997 |

OTHER PUBLICATIONS

Search Report.

* cited by examiner

*Primary Examiner*—Hoang Dang
(74) *Attorney, Agent, or Firm*—Sidley Austin Brown & Wood, LLP

(57) ABSTRACT

A drill including a stem (2,22) having at least one discharge groove (3) helically circumscribing the stem (2,22), and a drill head (4,24) provided at the end of the stem (2,22) opposite the end at which a shank is provided and having at least two hard metal bits (5,25) projecting radially beyond a drill head circumference, with the drill head further having drilling dust grooves (7,27) extending at least partially between the bits (5,25) and opening into the at least one discharge groove (3) and having, at least in a region of the at least two hard metal bits (5,25), an extended circumferential profile (8,28) projecting radially beyond a circumference (9,29) of the stem (2,22).

10 Claims, 2 Drawing Sheets

ROCK DRILL FOR DRILLING BORES IN REINFORCED CONCRETE

BACKGROUND OF THE INVENTION

1. Field of the Invention

The present invention relates to a drill, and, in particular, a rock drill including a stem having at least one discharge groove helically circumscribing the stem, and a drill head provided at one end of the stem and having at least two hard metal bits projecting radially beyond a drill head circumference and drilling dust grooves extending at least partially between the bits and opening into the at least one discharge groove.

2. Description of the Prior Art

For forming bores in concrete, brickwork, stone and the like, drills which have bits formed of a cutting metal, in particular hard metal, are used. The drills are usually inserted in hand-held tools which, in addition to a rotary drive, include a hammer mechanism for impacting the drill. The impacts blows are applied to the drill shank, which is received in a chuck of the drilling tool, and are transmitted through the drill stem and the drill head into a constructional component. In this way, the constructional component is shaved, chiseled, and chipped away. The drill should be able to meet high requirements with regard to drill feed, necessary force expenditures and have as long as possible service life.

Prior act discloses a number of drills which are characterized, under normal operational conditions, by satisfactory feed characteristics and force expenditures. Also, under normal operational conditions, their service life is also acceptable. Such a drill is disclosed, e.g. in European Publication EP-A-0 669 468. The drill has a stem with a shank provided at an end of the stem and adapted to be received in a hand-held tool, and a drill head provided at a stem end opposite the shank. The drill head has four bits which are provided in a star-shaped insert formed of a hard material. The bits are separated by drilling dust grooves which open in two discharge grooves for discharging the drilling dust and which helically circumscribe the stem. The known drill is capable of meeting the necessary requirements, in particular of a professional user, at small and medium bore diameters. However, for the use of the drill for drilling large diameter bores, it needs improvement. In particular, during drilling a bore in a reinforced concrete, the drill can encounter a reinforcing metal and be hooked over the reinforcing metal. The danger of a drill head being hooked over the reinforcing metal increases with an increase of a diameter of a to-be-drilled bore.

Accordingly, an object of the present invention is to eliminate the drawbacks of the prior art drills and provide a drill with which a danger of the drill being hooked over the reinforcing metal during drilling bores in a reinforced concrete is reduced even during drilling bores having a large diameter.

Another object of the present invention is to provide a drill having good feed characteristics at a reduced expenditure of force, and having an increased service life.

SUMMARY OF THE INVENTION

These and other objects of the present invention, which will become apparent hereinafter, are achieved by providing a drill, in particular a rock drill, including a stem having at least one discharge groove and a drill head provided at the end of the stem opposite the stem end provided with a shank and having at least two hard metal bits projecting radially beyond a drill head circumference. The drill head further includes drilling dust grooves extending at least partially between the bits and opening into the at least one discharge groove. The drill head also has, at least in a region of the at least two hard metal bits, an extended circumferential profile projecting radially beyond a circumference of the stem.

The formation of the drill head, in the region of the bard metal bits, with an extended circumferential profile reduces the extent of the radial projection of the bits with respect to the drill head. This structure counteracts the tendency of the projecting bits to hook over the reinforcing metal, without increasing in any substantial way the friction between the drill head and the bore wall. In addition, in particular when the hard metal bits, which are arranged in a circumferential region of the drill head, are formed as plate-shaped inserts, the inserts have a better support in their bottom region. A better embedding of the bits in the drill head reduces the danger of their loosening or falling out. It also increases the service life of the drill.

Preferably, the radially extended circumferential profile of the drill head projects radially beyond the stem circumference by a distance that amounts from about 2% to about 10% of the stem radius. With these values of the radial projection of the circumferential profile in question, a noticeable better support for the bits is provided, without increasing the friction between the drill and a bore wall.

In an advantageous embodiment of the present invention, the radially extended circumferential profile of the drill head extends on opposite sides of a side guide region of the hard metal bit over an angular region from about 5° to about 30°. The radial projection of the side guide region improves the retention of the drill in the reinforcing metal. The bits, which are generally formed as hard metal plates, are better embedded in the material of the drill head. As a result, the embedded hard metal bits are less sensible to the action of transverse forces acting in the circumferential direction upon removal of a bore wall material.

In case of the bits being formed as hard metal inserts, it is advantageous when the radially extended circumferential profile has an axial extension corresponding at least to an axial length of the bottom region of the hard metal bit embedded in the drill head. This insures the support of the bottom region of the bit along its entire axial extent. This prevents hooking of the bit over the reinforcing metal. Rather, due to the embedding of a bit in accordance with the present invention, the hard metal bit is smoothly guided along the reinforcing metal.

The friction resistance during the operation is reduced and the drill feed can be improved when the drill head circumferential profile in a region of the drilling dust grooves is spaced from a drill central axis by a distance smaller than a distance the guide region of a hard metal bit is spaced from the drill central axis.

In order to be able to reliably prevent hitting and hooking of edges, which are provided based on design considerations, upon encounting the reinforcing metal, advantageously, a projection of the radially extended circumferential profile is curved toward the leading edge of an adjoining drilling dust groove in the rotational direction of the drill. In this way, one of the causes of a possible hooking of the drill is eliminated. In case of encounting of a reinforcing metal, the drill continuously slides there along. By rounding the leading, in the rotational direction, edges, the sliding tendency is insured. This also insures a quasi-continuous transition of the projection into side guide region of the bit, and the danger of hooking of an edge on the drilling head with the reinforcing metal is substantially reduced.

In order to reduce the frictional forces acting on the wall of a drilled bore, advantageously, the drill head is formed so that its diameter in the entire side guide region of the hard metal bits, is larger than the diameter of the drill stem.

According to one of the embodiments of the present invention, the drill head has three hard metal bits which project beyond the drill head circumference. Advantageously, the hard metal bits are arranged symmetrically in a star-shaped pattern and are separated by respective, axially extending, drilling dust grooves.

According to one of the preferred embodiment of the present invention the hard-metal bits are formed as plate-shaped inserts inserted in an end surface of the drill head, with each plate-shaped insert having a side guide region which is so inclined to an axial extension of the radially extended circumferential profile that a free end of the plate-shaped insert is radially spaced from the drill head a distance larger than a distance an enbedded bottom portion of the insert is spaced from the drill head.

In this embodiment of the inventive drill, the cutting edges of the hard metal plates extend from respective bottom portions of the plates, which are completely embedded in the radially extended circumferential profile of the drill head, in a direction of respective free ends radially outwardly. This insures a sufficient radial projection, of the plate-shaped bits while simultaneously insuring, a good radial support of the bits. As a result, the frictional forces applied to the bore wall can be reduced.

For manufacturing reasons, in a further embodiment of the present invention, the entire drill head is formed of a hard metal. The higher costs of a drill according to this embodiment are more than compensated by the possibility to form the drill head with any arbitrary selected shape. Also, such a drill head is more easily handled and is more easily mounted.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

DETAILED DESCRIPTION OF THE PREFERRED EMBODIMENTS

Figure 1:
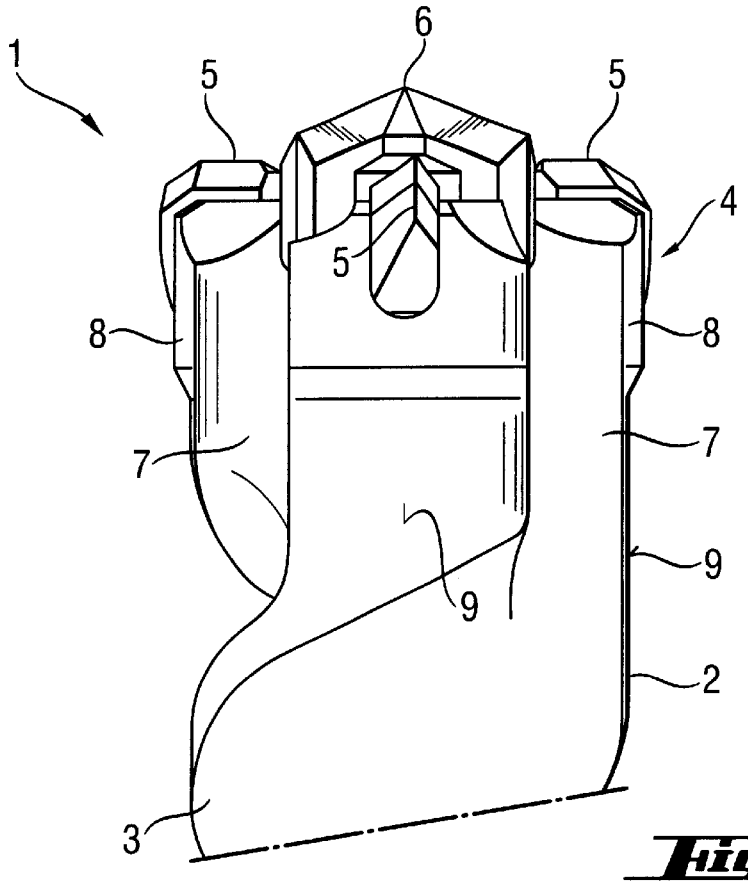
FIG. 1 a side view of a front section of a drill according to the present invention.
Figure 2:
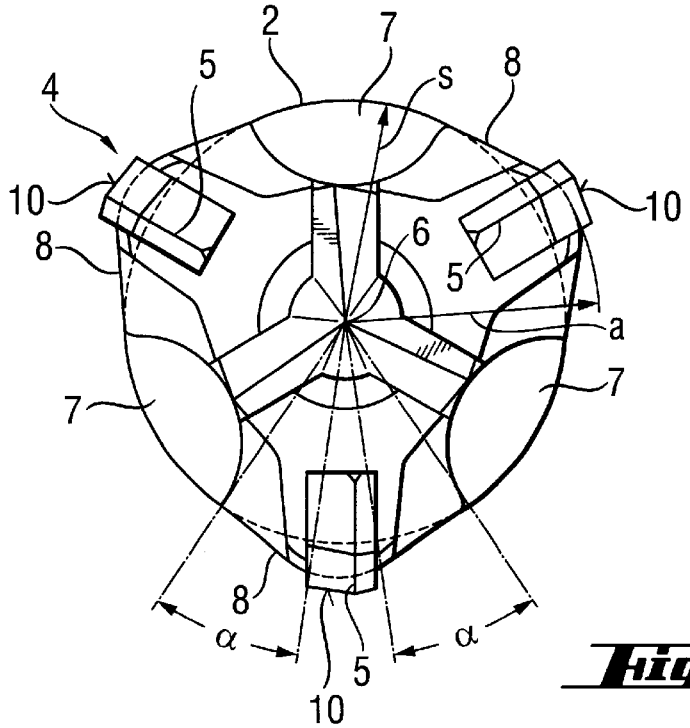
FIG. 2 a plan view of the drill shown in FIG. 1.

The drill according to the present invention, different view of which are shown in FIGS. 1–4, is designated generally with a reference numeral 1. The drill 1, which can be a rock drill, includes a stem 2 the rear end of which (not shown) adjoins a shank receivable in a chuck of a drilling tool. The stem 2 is provided with helical discharge grooves 3, which circumscribe the stem 2, for removing drillings produced during drilling of a hole. At the end of the stem 2 opposite the shank adjoining end, there is provided a drill head 4 having hard metal bits 5, 6. In the embodiment shown in FIGS. 1–2, the drill head 4 has two types of bits. In its center, the drill head 4 has a substantially star-shaped, three-prong central bit 6, the radial extend of which is essentially limited to the central region of the drill head 4. In the circumferential region of the drill head, there are provided three further bits 5 extending substantially radially and projecting radially beyond the circumference of the drill head 4. The circumferential bits 5 are formed, e.g., as plate-shaped inserts from hard metal and the bottom regions of which are embedded in radially extending grooves formed in the end surface of the drill head 4. The three circumferential bits 5 are, e.g., equidistantly angularly distributed along the circumference of the drill head 4. Between the circumferential bits 5, there are provided so-called head grooves 7 which open into the discharge grooves 3. Each of the head grooves 7 can be associated with its own discharge groove 3. However, the drill can have a lesser number of discharge grooves than of the head grooves. In this case, e.g., two head grooves can open into one discharge groove.

Figure 3:
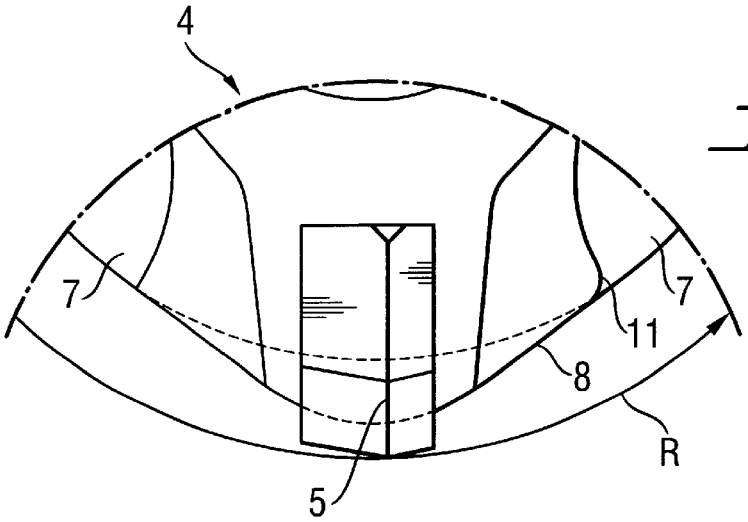
FIG. 3 a view of a detail of the plan view shown in FIG. 2.
Figure 4:
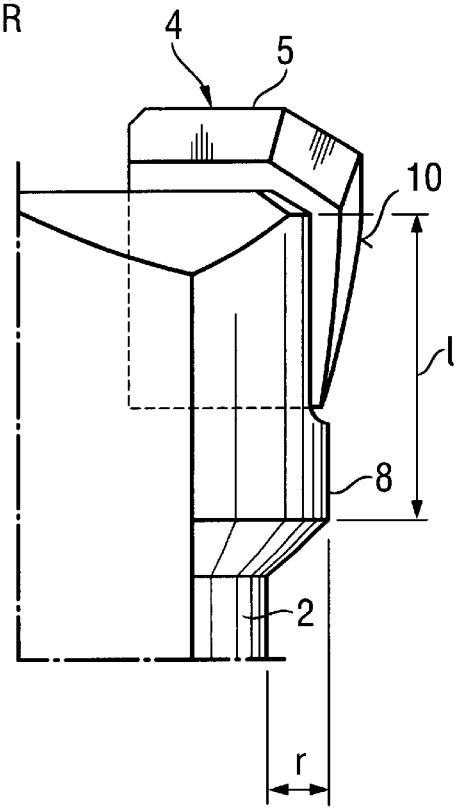
FIG. 4 a side view of a detail of the drill shown in FIG. 1 and pivoted with respect to the position shown in FIG. 1.

As can be seen in FIGS. 1–4, the drill head 4 has an extended circumferential profile 8 in the region of the hard metal bits 5. The circumferential profile 8 projects radially beyond the circumference 9 of the stem 2. For better clarity, the radial projection of the drill head region with the radially extended circumferential profile 8 is exaggerated in FIG. 2. The maximal radial projection r (FIG. 4) is determined as a difference between the maximal distance a of the radially extended drill head region 8 and the radius s of the stem 2. Preferably, the maximal radial projection r amounts to from about 2% to about 10% of the stem radius s. In the embodiment shown in the drawings, the radially extended drill head region 8 extends on opposite sides of the side guide region 10 of the hard metal bit 5 over an angular region a which amounts to from about 5° to about 30°. The axial extent of the radially extended region 8 is shown in FIG. 4 and is preferably as large or larger than the length of the bottom region of the bit 5 embedded in the drill head 4. As further shown in FIG. 4, the side guide regions or surfaces 10 of the circumferential bit 5 are inclined toward the axial extension 1 of the radially extended region 8. As a result of the inclination of the side guide surface 10 which, proceeding from the embedded bottom region, extends outwardly from the circumference of the drill head 4, the circumferential bits 5 have a larger radial projection, with respect to the drill head 4, at their free ends than in their bottom regions. As shown in FIG. 3, the projection of the drill head region with the radially extended profile 8 is curved toward the head drilling dust groove 7. Preferably, the leading edge of head drilling dust groove 7 is rounded in the rotational direction of the associated bit 5. It is in particular has a circular shape.

Figure 5:
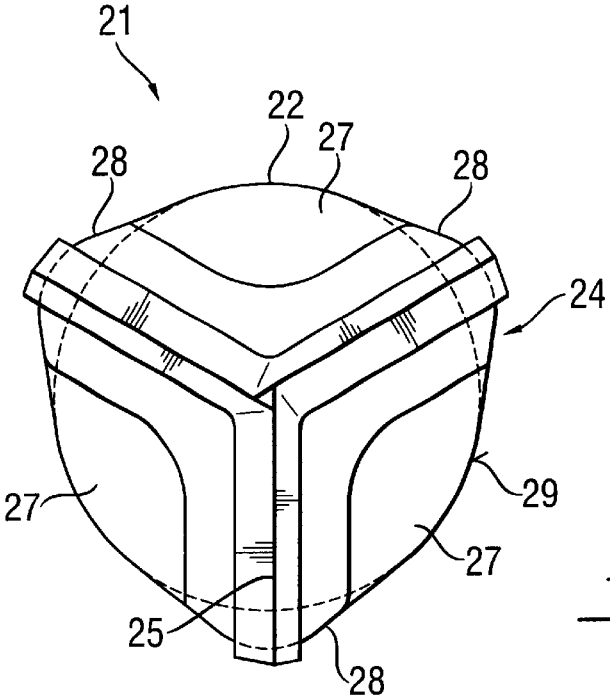
FIG. 5 a plan view of another embodiment of a drill according to the present invention.

The drill according to the present invention, which is shown in FIG. 5, is designated with a reference numeral 21. The drill 21 differs from the drill 1, shown in FIGS. 1–4, in that the drill head 24, which is provided on the stem 22, has only three bits 25 the arrangement of which resembles a star and which extend from the central region of the drill head 24 toward its circumference. The hard metal bits 25 project radially beyond the drill head 24 and are separated by head drilling dust grooves 27. The drill head 24 also has radially extended regions 28 which extend in the region of the bits 5 and project radially beyond the circumference 29 of the stem 22.

The drill head 4 or 24, as shown, have bits 5, 6 and 25 which are provided in the end surface of the drill head 4 or 24 and are formed as hard metal inserts. The drill head can also have a larger diameter than the stem. Further, the circumferential profile of the drill head is spaced, in the region of the head drilling dust grooves, by a smaller radial distance from the stem axis than the side guide surface of a bit provided in the circumference of the drill head.

According to one embodiment of the present invention, not shown, the entire drill head can be formed of hard metal.

While the invention was explained with reference to an embodiment of a drill with three bits arranged over the drill head circumference, it should be understood that the present invention is applicable to a drill with only two or more than three bits provided over its circumference.

Accordingly, though the present invention was shown and described with references to the preferred embodiments, such are merely illustrative of the present invention and are not to be construed as a limitation thereof, and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A drill, comprising a stem having at least one discharge groove helically circumscribing the stem; and a drill head provided at one end of the stem and having at least two hard metal bits projecting radially beyond a drill head circumference, and drilling dust grooves extending at least partially between the bits and opening into at least one discharge groove, the drill head having, at least in a region of the at least two hard metal bits, an extended circumferential profile projecting radially beyond a circumference of the stem and extending on opposite sides of a side guide region (10) of a hard metal bit over an angular region from about 5° to 30°.

2. A drill according to claim 1, wherein the radially extended circumferential profile projects radially beyond the stem circumference by a distance (r) amounting from about 2% to about 10% of a stem radius (s).

3. A drill according to claim 1, wherein the radially extended circumferential profile has an axial extension corresponding at least to an axial length of a bottom region of a hard metal bit embedded into the drill head.

4. A drill according to claim 1, wherein the drill head circumferential profile in a region of the drilling dust grooves is spaced from a drill central axis by a distance smaller than a distance of a guide region of a bard metal bit from the drill central axis.

5. A drill according claim 4, wherein a projection of the radially extended circumferential profile is curved toward a leading edge of an adjoining drilling dust groove in a rotation direction of the bits.

6. A drill according to claim 1, wherein the drill head has three hard metal bits projecting beyond the drill head circumference and arranged in a star-shaped pattern.

7. A drill according to claim 1, wherein the drill head has four hard metal bits projecting beyond the drill head circumference, and an extended circumferential profile in a region of all of the hard metal bits which projects radially beyond a stem circumference.

8. A drill head according to claim 1, wherein the drill head has, in an entire side guide region of the hard metal bits, a diameter which is larger than the stem diameter.

9. A drill according to claim 1, wherein the hard-metal bits are formed as plate-shaped inserts inserted in an end surface of the drill head, wherein each plate-shaped insert has a side guide region which is so inclined to an axial extension of the radially extended circumferential profile that a free end of plate-shaped insert is radially spaced from the drill head a distance larger than a distance an embedded bottom portion of the insert is spaced from the drill head.

10. A drill according to claim 1, wherein an entire drill head is formed of hard metal.

* * * * *